US006464382B1

(12) United States Patent
Duflos

(10) Patent No.: US 6,464,382 B1
(45) Date of Patent: Oct. 15, 2002

(54) LIGHTING OR INDICATING APPARATUS FOR A MOTOR VEHICLE, HAVING IMPROVED LIGHT DIFFUSING MEANS

(75) Inventor: Vincent Duflos, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 28 days.

(21) Appl. No.: 09/611,579

(22) Filed: Jul. 5, 2000

(30) Foreign Application Priority Data

Jul. 6, 1999 (FR) ..... 99 08696

(51) Int. Cl.[7] ..... F21V 5/00
(52) U.S. Cl. ..... 362/520; 362/311; 362/330
(58) Field of Search ..... 362/326, 327, 362/328, 330, 329, 355, 308, 311, 520, 336

(56) References Cited

U.S. PATENT DOCUMENTS 4,191,943 A 3/1980 Cairns et al.
5,004,785 A 4/1991 Ida et al.
5,820,246 A * 10/1998 Helstern ..... 362/326

FOREIGN PATENT DOCUMENTS

| | | |
|---|---|---|
| BE | 450 110 | 3/1943 |
| FR | 1 263 430 | 10/1961 |
| GB | 1 576 408 | 10/1980 |

OTHER PUBLICATIONS

French Search Report dated Feb. 18, 2000.

* cited by examiner

*Primary Examiner*—Y. My Quach-Lee
(74) *Attorney, Agent, or Firm*—Morgan & Finnegan, LLP

(57) ABSTRACT

Lighting apparatus for a motor vehicle, for illuminating or signalling purposes, comprises a light source cooperating with optical diffusing means. The diffusing means comprise a plate through which the light passes from the light source. The mass of this plate is made of a transparent first material having a first refractive index, and in which are embedded inclusions of a transparent second material having a different refractive index.

15 Claims, 4 Drawing Sheets

LIGHTING OR INDICATING APPARATUS FOR A MOTOR VEHICLE, HAVING IMPROVED LIGHT DIFFUSING MEANS

FIELD OF THE INVENTION

The present invention relates in general terms to light emitting apparatus for a motor vehicle. Such apparatus typically comprises external indicating lights or signal lights, normally mounted on the outside of the vehicle; but it may also consist, for example, of lights for giving internal illumination, or warning lights for the driver of the vehicle.

BACKGROUND OF THE INVENTION

A motor vehicle indicating light conventionally comprises a light source, which is typically the filament of an incandescent lamp, together with optical means which are arranged to propagate the light flux which is emitted by the source in such a way as to satisfy a photometric grid laid down by regulations. In this type of indicating function, this grid is of a minimum size, which is well defined both in height and in width, and the light must be distributed essentially homogeneously within this grid.

In order to attain these objectives, it is usual practice to include in the optical means a flux recuperator such as a Fresnel lens or a parabolic reflector which is focused on the light source, together with means for diffusing the light by refraction, which typically take the form of motifs which are in general arranged on the internal surface of the front optic, or cover lens, of the indicating light. Such motifs may for example consist of striations or spherical or toroidal projecting elements.

The said optical means fulfil the required functions as far as the traffic or vehicle lighting regulations are concerned, but they do in general give the indicating light an irregular appearance when it is extinguished and seen from outside. In addition, it will easily be understood that they call for a particularly large amount of design work and theoretical study of the photometry in order to manufacture the mould in which the optical element concerned is to be made.

In this connection, techniques are known that are intended to improve, firstly the homogeneity of the beam produced by an illuminating or indicating device, and secondly its appearance when extinguished. One of these techniques consists in frosting the surface of the flux recuperating reflector associated with the lamp, and/or the optic or cover glass of the apparatus. In particular, when such frosting is effected on the outer face of an optic, it masks, to some degree, the refracting reliefs formed on its internal face.

Such frosting does however have the disadvantage that it makes it necessary to do additional work on the component concerned, which is detrimental to the eventual cost of the apparatus as a whole. In addition, when the internal face of an indicating light optic is frosted in this way, the frosting may become changed, for example by abrasion in the mould, or due to wear in the mould so that the amount of frosting in the components produced in a long production run in the same mould will gradually deteriorate. Finally, the frosting is difficult to adjust precisely to the requirements of the indicating light in terms of photometry or homogeneity of appearance.

DISCUSSION OF THE INVENTION

A main object of the present invention is to overcome the above mentioned drawbacks of the state of the art. More precisely, the present invention proposes first to make indicating lights having an external appearance when extinguished which is very homogeneous without any frosting, or depolishing, having to be carried out, treatment whatever, while at the same time considerably simplifying the form, and therefore the design and moulding, of the optical components which diffuse the light.

Accordingly, the present invention proposes a lighting and/or indicating apparatus for a motor vehicle, comprising a light source which cooperates with optical means for diffusing the light, characterised in that the light diffusing means comprise a plate through which the light issued from the light source can pass, the mass, that is to say the body, of the said plate being made of a transparent first material having a first refractive index and in which inclusions are embedded, the inclusions being of a transparent second material having a second refractive index different from the first.

The inclusions are preferably generally spherical. Their size is preferably in the range between about 0.1 $\mu$m and 100 $\mu$m. Preferably, the inclusions constitute between 0.05 and 5% of the weight of the plate.

According to a preferred feature of the invention the said first material is a polymethylmethacrylate, the second material being a copolymer of the polyacrylate family.

The two said materials may be uncolored, or the first material may be colored and the second uncolored, or they may both be colored.

Refracting reliefs may be formed on one of the faces of the plate. The plate may constitute a cover glass, or globe, or optic of the apparatus.

The apparatus may for example be an external indicating light or an internal illuminating light, or an indicating light for giving signals to the driver of the vehicle.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
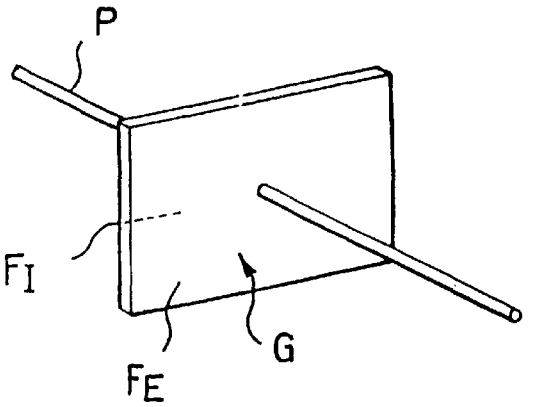
(PRIOR ART) FIG. 1
FIG. 1 is a diagrammatic perspective view showing the behaviour of a conventional transparent optic with smooth faces, with a narrow pencil of light passing through it.
Figure 1:
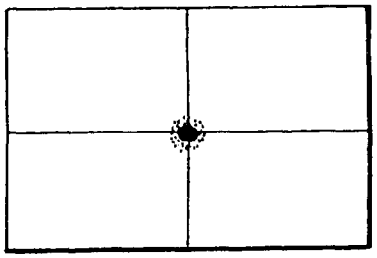
(PRIOR ART) FIG. 1

Reference is first made to FIG. 1, which shows a conventional transparent optic G, the inner and outer faces FI and FE respectively are smooth and parallel to each other. The optic is made for example of polymethylmethacrylate, and has a thickness of a few millimetres.

A pencil of light P, which is incident orthogonally on the inner face of the optic, is left substantially intact by the latter, and the appearance of the pencil of light on exit from the optic is illustrated on the photometric grid which constitutes the right hand part of FIG. 1.

It will be understood that such a conventional optic with smooth polished faces has no diffusing power other than the very small ability to diffuse due to imperfections in its manufacture, and it is by means of suitable refractive means which are provided on at least one of its faces that the light can be attenuated so as to fill the photometric grid in a suitable way.

Figure 2:
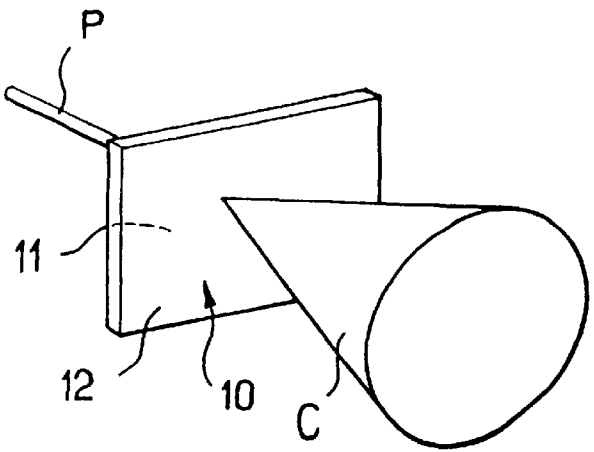
FIG. 2 is a diagrammatic perspective view showing the behaviour of a transparent optic with smooth faces made in accordance with the present invention, when the same narrow pencil of light passes through it.
Figure 2:
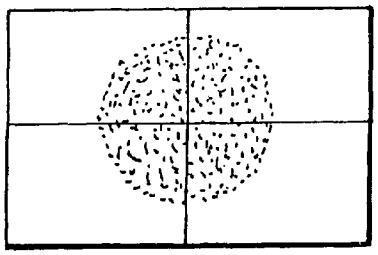
Figure 3:
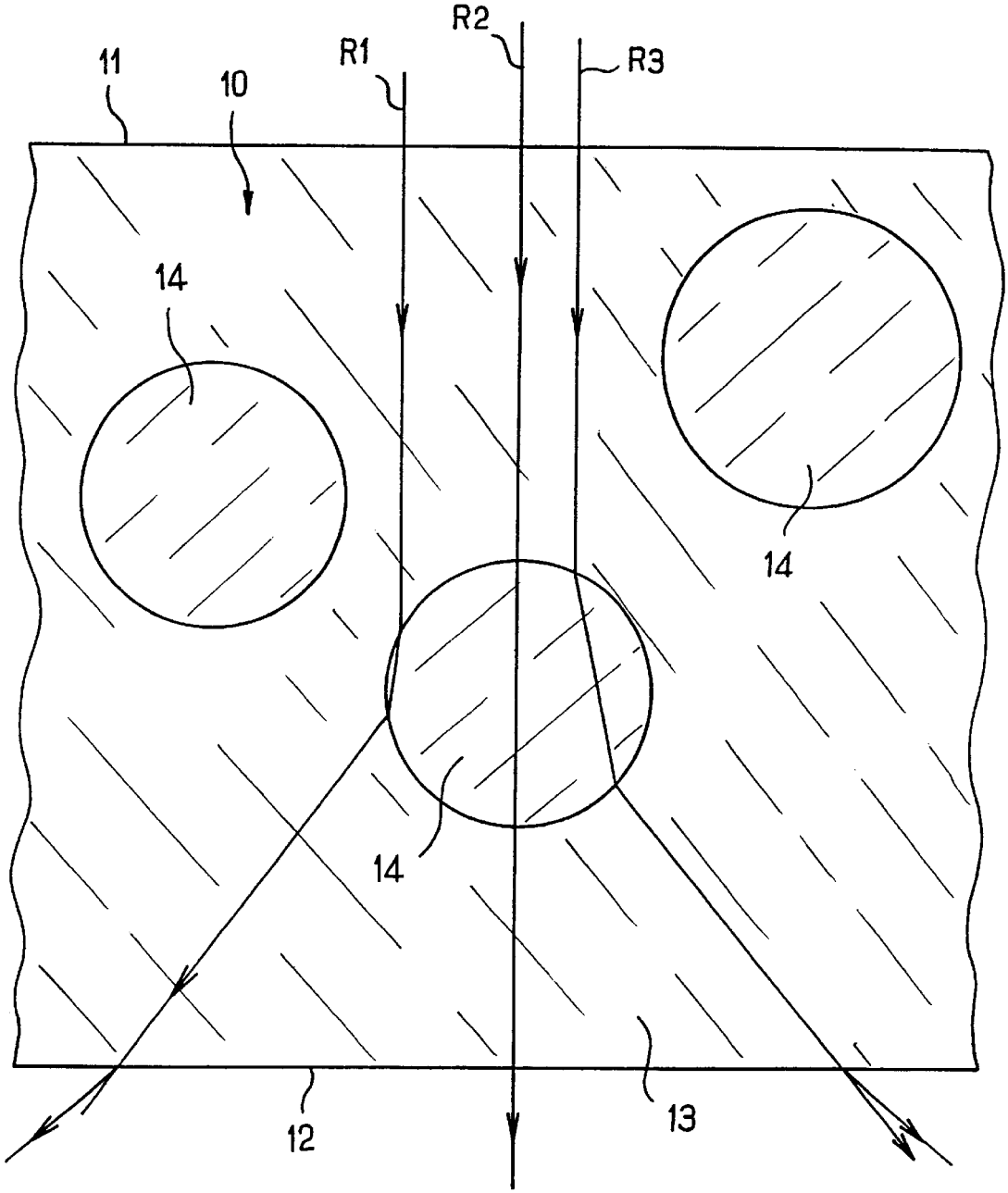
FIG. 3 is a view in cross section on an enlarged scale, showing the smooth-faced optic of FIG. 2 once again.

Reference is now made to FIGS. 2 and 3, in which an optic, which may be a plain glass such as a cover glass, or some other optical element such as an intermediate optical plate, is formed in accordance with the invention by moulding in a plastics material such as polymethylmethacrylate, to which inclusions of another transparent material, having a different refractive index from that of the methacrylate base material, are added.

These inclusions preferably take the form of balls which are generally spherical and of a diameter of between a fraction of a micrometre and a few tens of micrometres. The inclusions are incorporated in the methacrylate base material, either during manufacture of the blocks which are subsequently cast in order to form the optic by moulding, or immediately upstream of the moulding equipment in the production line. They are added in a proportion which may for example be in the range from 0.05 to 5% of the total weight of the optic.

Preferably, these inclusions have a multi-layer structure with a core and one or more successive outer layers, in which the outermost layer, or envelope, consists of reticulated polymethylmethacrylate, while the core and any intermediate layers are made from at least one copolymer of a member or members of the polyacrylate family of compounds.

More generally, it is desirable that the ratio between the refractive indexes of the mass of the optic and the inclusions lies in the range between about 0.93 and 1.02. At the same time, this ratio must of course be different from 1, and the arithmetical different in between the two indices is preferably greater than 0.01

FIG. 3 shows in more detail the behaviour of the light inside the plate which constitutes the mass or body of the optic, and in which the inclusions are embedded. The optic is designated by the reference 10, with its input and output faces being indicated at 11 and 12 respectively. The mass or body, of polymethylmethacrylate, is indicated at 13, and the inclusions at 14.

In FIG. 3, by way of example, three parallel light rays close to each other, R1, R2 and R3, are shown as incident on one of the inclusions 14; and having regard to the various inclinations of the diopters situated at the interface between the mass of the optic 13 and the inclusion 14, these rays all undergo different deflections as shown.

It will accordingly be understood that by multiplying the inclusions in an appropriate density inside the optic, radiation will be obtained at the output side of the latter which is diffused in a multi-directional way, and that this radiation is homogeneous to an extent that increases in inverse relationship to the size and number of the inclusions 14.

Thus, FIG. 2 shows the diffusion of the light within a cone C having at its apex a cone half angle which depends essentially on the density and size of the inclusions, and on the respective refractive indices of the mass of the optic and the inclusions themselves. As a result, on the photometric grid which constitutes the right hand part of FIG. 2, an essentially circular patch of light occupies a very substantial part of the height of the grid.

It will be noted here that, having regard to the thickness of the optic 10 and the size of the inclusions 14, the rays will be generally deflected in multiple deflections on successive inclusions 14, which contributes to generally good homogeneity in the diffusion.

Figure 4:
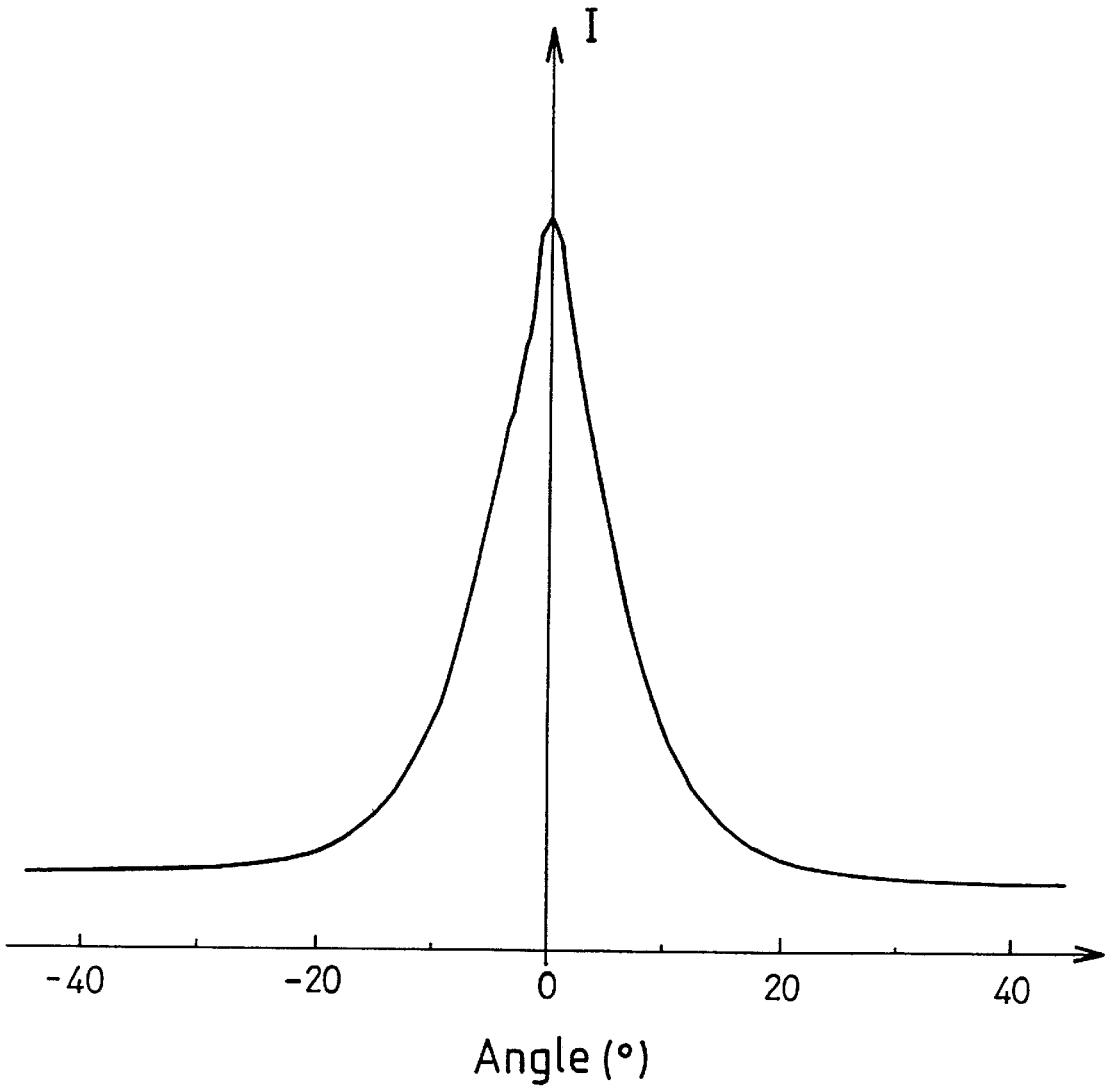
FIG. 4 is a diagram showing the behaviour of an actual example of a smooth-faced optic in accordance with the invention, in terms of angles of diffusion of the incident light.

Reference is now made to FIG. 4, which shows one example of the angular distribution at the output side of the optic G, having smooth faces and a thickness of 3 millimetres. In this example, the inclusions are in a concentration of 1% by weight, the inclusions having a diameter in the range from 1 to 10 $\mu$m, and the ratio of the refractive indexes of the mass of the optic and the inclusions is equal to 0.98.

In the case where the various parameters have values such that the maximum deviations in the horizontal and vertical directions that are obtained within the optic are sufficient to fill the imposed photometric grid, the optic can then have smooth, polished faces.

Figure 5:
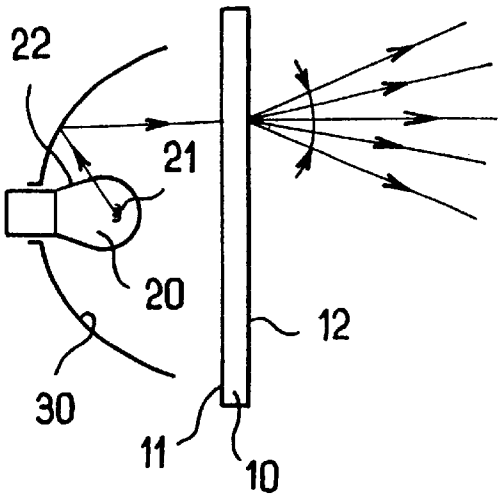
FIG. 5 is a diagrammatic view in axial cross section, showing an indicator light of a motor vehicle. equipped with an optic in one form according to the present invention.

A diagrammatic example of a motor vehicle indicator light which incorporates such an optic according to the invention is shown in FIG. 5, to which reference is now made. It includes a lamp 20 having an incandescent filament 21 situated in the focal region of a parabolic flux recuperating reflector 30. The latter directs substantially parallel radiation on the input face 11 of an optic 10 with smooth faces made as described above. At the output side of the optic, the diffused beam fills the photometric grid in a suitable way.

It will be noted here that, when the output radiation of the indicator light has to be colored, the coloration may be supplied for example by the bulb 22 of the lamp 20, or by the mass 13 of the optic 10, appropriately colored, or again by an intermediate screen interposed between the reflector 30 and the optic 10.

It is relevant to notice in this connection that, when an indicator light of this kind, that is to say in accordance with the invention, is extinguished, the optic prevents the space inside the indicator light from being seen clearly. As a result, a colored element for imparting its specific color to the light beam produced by the unit will hardly be visible from outside, so that the outside appearance of the indicator light is that of one which is essentially uncolored. This is an effect which styling designers often require.

Figure 6:
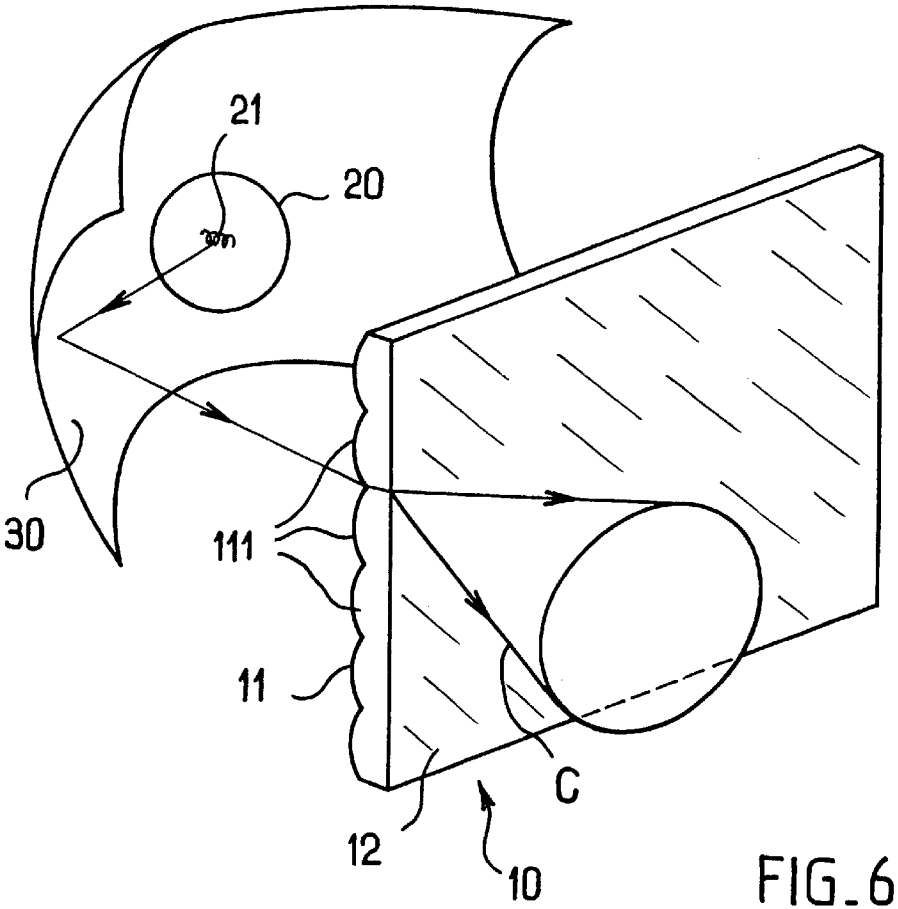
FIG. 6 is a diagrammatic perspective view showing a motor vehicle indicator light equipped with another form of optic in accordance with the invention.

Reference is now made to FIG. 6, which shows a further embodiment of the invention in which diffusing inclusions of the kinds described above are combined in the same optic 10 with means for deflecting the light by refraction, in this example at the level of the inlet face 11 of the optic. In this example, these refraction means consist of toroidal elements 111, each of which produces a spreading effect which combines with the diffusion produced by the inclusions.

Thus the beam which is obtained will be the result of the combination of the deflections produced by the toroidal elements 111 on the input face 11 and by the inclusions 14. In addition, because a part of the deflection is produced by the inclusions, the toroidal elements 111 may be substantially less prominent, in terms of radii of curvature, than in the case of a conventional optic in which similar toroidal elements must themselves do all the work of refracting the generally parallel incident rays.

It will be understood that such an indicator light has a very high degree of homogeneity, as regards light emitted through its illuminating area when lit, and as regards the appearance of its illuminating area when it is extinguished.

The present invention is of course in no way limited to the embodiments described above and shown in the drawings: a person skilled in this particular technical field will readily be able to apply numerous variations and modifications to it.

What is claimed is:

1. Light emitting apparatus for a motor vehicle, comprising:

a light source;

a diffusing means disposed in relation to the light source so as to receive light from the light source to diffuse said light, wherein said diffusing means comprise a plate translucent to said light, said plate comprising a mass of a transparent first material having a first refractive index; and a plurality of inclusions embedded in said mass, each of said inclusions having a multi-layered structure, said multi-layered structure having a core and at least one successive layer, wherein said core and said at least one successive layer are constructed from different materials, at least one successive layer being constructed of said first material and said core being of a transparent second material having a second refractive index different from the first refractive index, wherein ratio x of said first refractive index and said second refractive index lies in the range of $0.93 \leqq x < 1$ and $1 < x \leqq 1.02$, wherein said ratio is not 1.

2. Apparatus according to claim 1, wherein each of said inclusions is substantially spherical in shape.

3. Apparatus according to claim 1, wherein each of said inclusions has a size in the approximate range 0.1 $\mu$m to 100 $\mu$m.

4. Apparatus according to claim 1, wherein said inclusions constitute a proportion in the range 0.05 to 5% of the weight of the plate.

5. Apparatus according to claim 1, wherein said first material is a polymethylmethacrylate and said second material is from the family of polyacrvlates.

6. Apparatus according to claim 1, wherein said first and second materials are uncolored.

7. Apparatus according to claim 1, wherein said first material is colored and said second material uncolored.

8. Apparatus according to claim 1, wherein the said first and second materials are colored.

9. Apparatus according to claim 1, wherein said plate has two opposed faces, with reliefs formed on one of said faces for deflecting said light by refraction.

10. Apparatus according to claim 1, wherein said plate is a component selected from the group consisting of cover glasses, globes and optics.

11. Apparatus according to claim 1, wherein the apparatus comprised of said light source and said diffusing means is an indicating light for mounting outside of said motor vehicle.

12. Apparatus according to claim 1, wherein the apparatus comprised of said light source and said diffusing means is an internal illuminating apparatus of said vehicle.

13. Apparatus according to claim 1, wherein the apparatus comprised of said light source and said diffusing means is an apparatus for mounting inside the motor vehicle for giving signals to a driver of the vehicle.

14. A light emitting apparatus for a motor vehicle, comprising:

a light source;

a refraction means located in front of said light source so as to receive light from said light source and diffuse said light, said refraction means comprising a plate having a first side proximate to said light source and a second side, said plate being translucent to said light; said first side having a plurality of toroidal elements thereon such that said light falls upon said toroidal elements; and inclusions embedded in said plate, each of said inclusions having a multi-layered structure, said multi-layered structure comprising a core and at least one successive layer, wherein said core and said at least one successive layer are constructed from two different materials, wherein ratio x of refractive index of said two different materials lies in the range of $0.93 \leqq x < 1$ and $1 < x \leqq 1.02$ wherein said ratio is not 1.

15. The light emitting apparatus of claim 14, wherein said plate and said at least one successive layer are constructed of polymethylmethacrylate and said core is constructed of a material from the family of polyacrylates.

* * * * *